US005188237A

United States Patent [19]

Schwamborn

[11] Patent Number: 5,188,237

[45] Date of Patent: Feb. 23, 1993

[54] DEVICE FOR THE SEPARATION OF POWDERS INTO COARSE AND FINE COMPONENTS

[75] Inventor: K. H. Schwamborn, Bonn, Fed. Rep. of Germany

[73] Assignee: Hosokawa Mikropul Gesellschaft für Mahlund Staubtechnik mbH, Cologne, Fed. Rep. of Germany

[21] Appl. No.: 687,990

[22] Filed: Apr. 19, 1991

[30] Foreign Application Priority Data

Feb. 8, 1991 [DE] Fed. Rep. of Germany ... 9101419[U]

[51] Int. Cl.[5] ..... B07B 9/00; B04C 3/00

[52] U.S. Cl. ..... 209/23; 209/144; 55/398; 55/459.1

[58] Field of Search ..... 209/21, 22, 144, 36, 209/37, 28, 29, 23; 55/459.1, 398

[56] References Cited

U.S. PATENT DOCUMENTS

| | | | |
|---|---|---|---|
| 2,790,554 | 4/1957 | Work | 55/459.1 X |
| 3,095,369 | 6/1963 | Jager | 209/144 X |
| 3,353,340 | 11/1967 | Carsey | 55/459.1 X |
| 4,477,339 | 10/1984 | Whaley et al. | 209/144 X |
| 4,784,755 | 11/1988 | Taylor | 209/136 |

FOREIGN PATENT DOCUMENTS

| | | | |
|---|---|---|---|
| 855044 | 9/1952 | Fed. Rep. of Germany | 209/144 |
| 860927 | 11/1952 | Fed. Rep. of Germany | 209/144 |
| 932001 | 7/1955 | Fed. Rep. of Germany | 209/144 |
| 401630 | 11/1933 | United Kingdom | 209/144 |
| 740324 | 11/1955 | United Kingdom | 209/144 |
| 2044639 | 7/1980 | United Kingdom | 209/144 |

*Primary Examiner*—Donald T. Hajec
*Attorney, Agent, or Firm*—Felfe & Lynch

[57] ABSTRACT

A device for the separation of a powder into a coarse component and a fine component with a housing 1, a material feed 3, 4 into the housing for the material to be fed and a coarse material discharge 8 for the housing and a fines discharge 19 for the housing. The housing 1, the material feed 3, 4 as well as the material discharge systems 8, 19 form a cyclone separator and a sifter 14 is positioned between the material feed 3, 4 and the fines discharge 19.

8 Claims, 3 Drawing Sheets

DEVICE FOR THE SEPARATION OF POWDERS INTO COARSE AND FINE COMPONENTS

Figure 1:
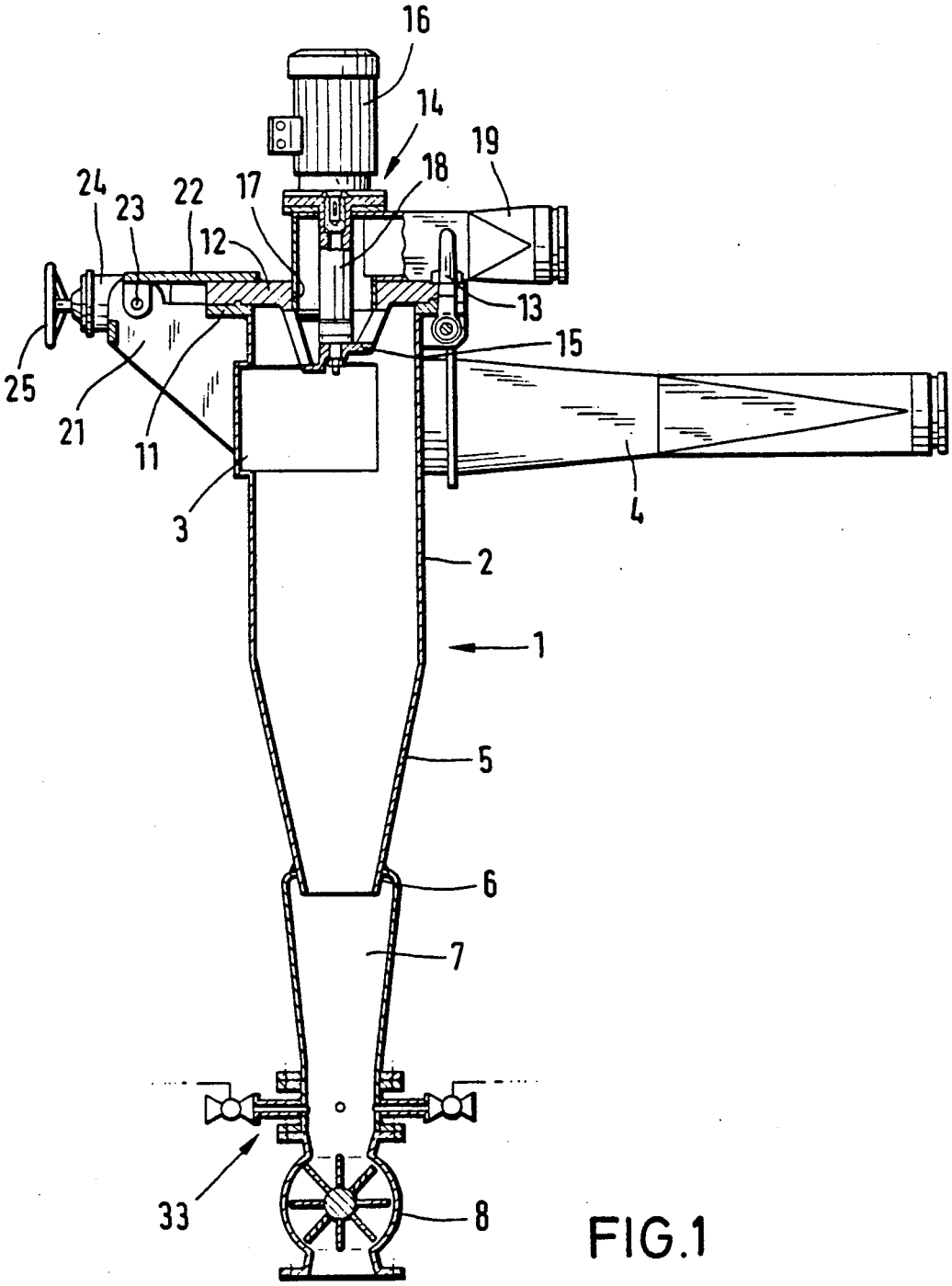

The invention refers to a device for the separation of a powder into a coarse component and a fine component with a housing, with a feed arrangement for the material to be fed and with a coarse material discharge and a fines discharge.

In the manufacture, treatment and/or processing of powders, for example in the area of coating powder manufacturing, ever greater requirements are placed on the particle size distribution. Narrow particle size distribution curves, i.e. a sharp top size limitation as well as an effective fines removal, represent the goals in this area. The narrower the particle size distribution curves need to be, the more difficult it is to meet these goals.

It is a known fact that cyclone separators or dynamic separators are best used for separating powders into a coarse component and a fine component. The properties of these known devices, however, are proving less and less able to meet the requirements for particle size distribution curves described above.

The task of the present invention is to create a device of the type described above which makes possible a separation with sharp particle size limitations, and can thus fulfil the high expectations with reference to the manufacture of powders with narrow particle size distribution curves.

According to the invention, the task is solved in that the housing, the material feed and the material discharge segments of the device according to the invention are constructed as a cyclone separator and that a sifter, preferably a dynamic sifter with sizing wheel and drive, is attached between the material feed and the fines removal. In a device of this type, both the properties of a cyclone separator as well as those of a sifter are utilized. The use of the cyclone-typical gas and particle flow, which is determined by the geometric dimensioning and shape of the cyclone housing, results in a significant spatial separation of the coarse flow in the wall area from the fines flow in the central/axial region of the housing and thus to greater separation efficiencies. A sharp top size limitation, without oversize particles of any sort and with controlled separation of the finest particles, i.e. a bottom size limitation, dedusting becomes possible. The dispersion of the feed material, which is generated by means of gas acceleration in the product feed line, is advantageous for a good separation effect. To achieve this effect, the sectional area of the feed tube decreases accordingly. In addition, the blowing of a helical air-flow against the sizing wheel has proven to be advantageous. This is determined by the feed spiral of the cyclone housing and occurs, as is functional, with a rotational direction which agrees with the direction of rotation of the sizing wheel. By means of the cyclone separator according to the invention, a sharp separation of coarse from fine components can be achieved even for separation limits in the particle size range of 50 to 250 microns. For this reason, depending on the use and the setting of the dynamic separator, powders with astonishingly narrow particle size distribution curves can be achieved.

The action of a secondary sizing chamber connected to the conical section of the cyclone housing, which is provided with nozzles for gas supply, is particularly advantageous. The effect of such a gas supply is to "wash out" the coarse component of the material as it drops, which further improves the separation sharpness.

For reasons of improved operation, the separator is mounted on a plate together with the fines discharge and attached to the housing in such a fashion so that it can be removed. This permits the replacement of the sifter with a plunger tube, so that the device according to the invention can be operated as a cyclone separator.

Figure 2:
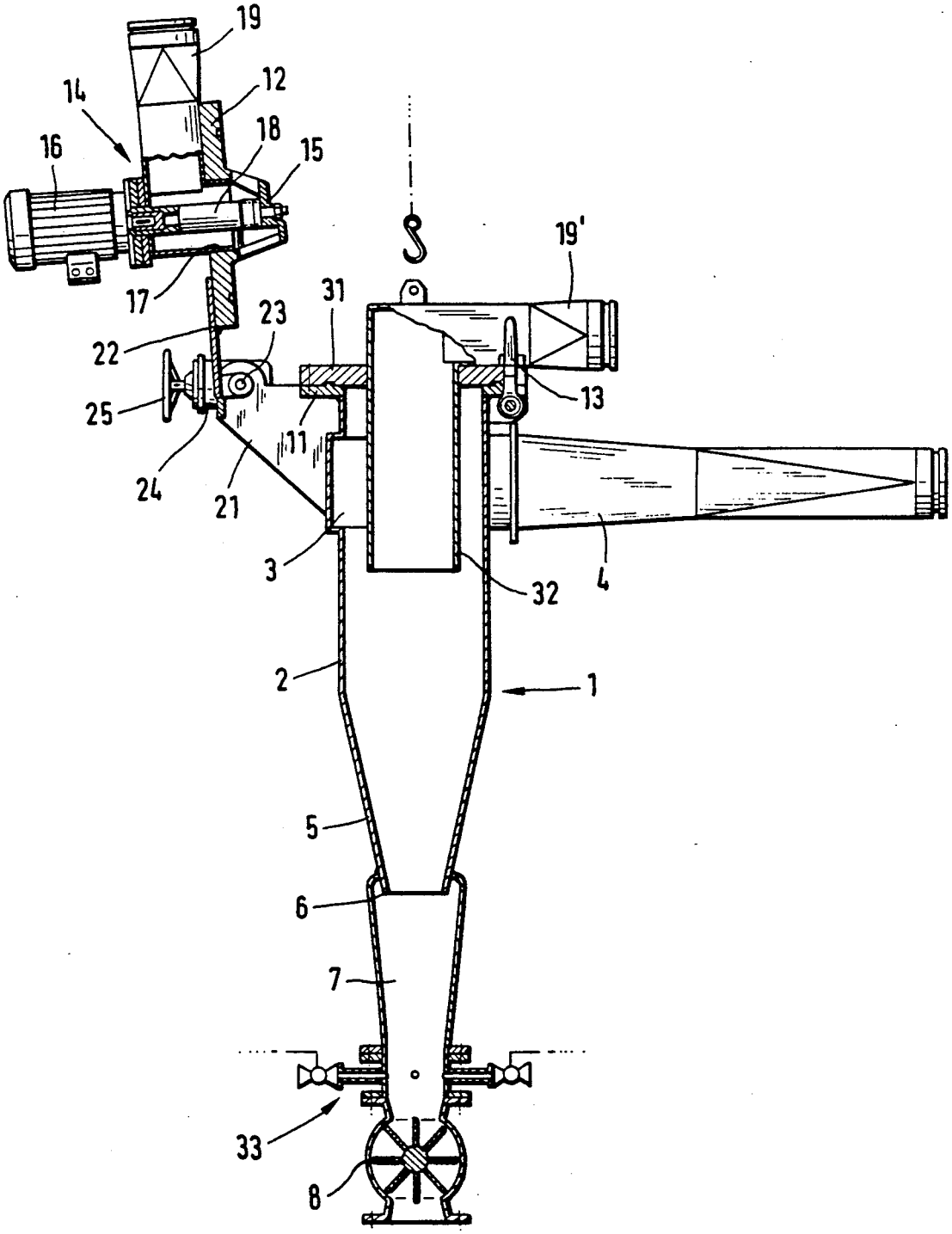
Figure 3:
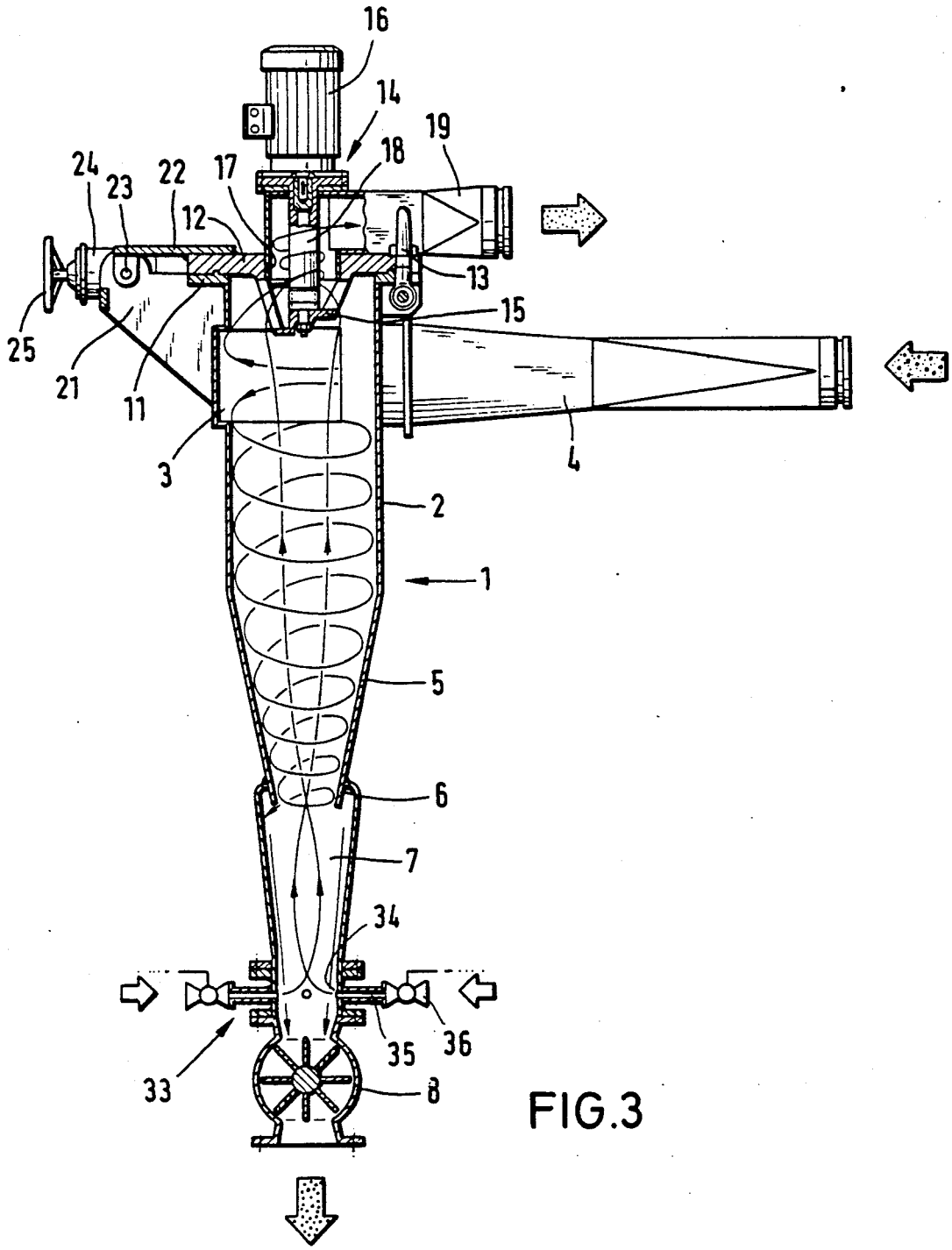

Further advantages and detail of the invention are to be explained using the construction examples represented in FIG. 1 to FIG. 3. These depict the following:

FIG. 1 is a diagrammatic elevational view, partly in section, of a device according to the invention, FIG. 2 is a diagrammatic elevational view, partly in section, of a device according to the invention with sifter pivoted out and plunger tube inserted and FIG. 3 is a diagrammatic elevational view, partly in section, of a device according to the invention with the flow paths indicated by lines.

In all Figures, the housing of the device according to the invention is designated with 1. It comprises the upper cylindrical section 2, into which the product feed line 4 opens in the form of a feed spiral 3. The next section downwards is the conical housing section 5, which is typical of cyclone separators, and which opens via its spin cut-off edge 6 into the secondary sizing chamber 7. A cellular wheel sluice 8 is provided for the removal of the coarse component from the secondary sizing chamber 7.

The upper section of the housing 1 is provided with a horizontal flange 11. In the design examples depicted in FIG. 1 and FIG. 3, a plate 12 rests on this flange 11, to which it is fastened with several screws 13 (only one is depicted here) in a releasable manner. The plate 12 is the mounting for the dynamic separator 14. This comprises the sizing wheel 15 (two sizes are shown), which is located directly below plate 12. The drive motor 16 is positioned above plate 12. Plate 12 is provided with a central opening 17, through which the drive shaft 18 passes. At the same time, the opening 17 in plate 12 is also part of the discharge for the fine material components. The angled discharge line 19 is connected to the opening 17.

In order to be able to set the separation limit, the speed of the sizing wheel 15 is adjustable. For reasons of function, the direction of rotation is selected so that the sizing wheel 15 and the helical product flows rotate in the same direction.

A mounting block 21 is provided on housing 1. A support 22 is mounted on the mounting block 21 above joint 23. This support is connected to plate 12. Joint 23 is provided with a gear unit 24 and a hand wheel 25. These devices permit plate 12 together with sifter 14 and outlet tube 19 to be lifted e.g. swivelled out of the flange of housing 1 to a position such as is depicted in FIG. 2, after release of screws 13.

As further shown in FIG. 2, an additional plate 31 can be attached to flange 11 when separator 14 is withdrawn from housing 1, which supports a plunger tube 32 passing through plate 31. Plunger tube 32 terminates below the product feed spiral 3. The angled product discharge line 19' is joined at the top end of the plunger tube 32. In this manner, the device according to the invention is converted to a cyclone separator. Plate 31 is simultaneously the top plate of the cyclone separator.

For reasons of improved operation, the secondary sizing chamber 7 is mounted to housing section 5 in a releasable manner. This allows the possibility of initially purchasing the device according to the invention as a cyclone separator and subsequently retrofitting the sifter 14 and the secondary sizing chamber 7 at a later date.

The function of the device according to the invention is to be explained using FIG. 3, in which flow paths are indicated by arrows. The gas-material mixture enters the housing 1 via the feed line 4 and the feed spiral 3. The carrier gas is removed mainly through the opening 17 and the discharge line 19. In the process, it carries the finer component of the material with it. The desired particle size limitation is set with the aid of the adjustable sifter 14. Product particles with a granular size exceeding this limit are ejected by the sizing wheel 15 and enter the secondary sizing chamber 7 along with the coarse material component. In order to further improve the separation sharpness, the secondary sizing chamber 7 is equipped with a gas supply system 33. This comprises nozzles 34 opening into the secondary sizing chamber 7, to which gas supply lines 35 with valves 36 are connected. The gas, which enters the chamber at high speed, flows upward through the central area of housing 1, carrying residual fines with it. Sufficiently fine material components are transported to the product discharge line 19 by the sizing wheel 15. Any particles with a granular size exceeding the desired top size limitation are ejected by sizing wheel 15 and return to the secondary sizing chamber 7. Particularly sharp separation limits can be achieved by means of this device. The separation limit is continuously adjustable over an extremely broad range of from 8 to 300 microns.

When the device according to the invention is converted to a cyclone separator (FIG. 2), a gas supply to the secondary sizing chamber is not necessary. In this case, the valves 36 are closed.

FIG. 3 also shows that the sectional shape of the relatively long feed tube 4 changes from round to rectangular (opening in feed spiral 3). In accordance with function, the sectional area is reduced in such a way that an acceleration is effected, for example from 20 m/s to 30 m/s. The result is a product dispersion in feed tube 4 which further improves the separation efficiency.

I claim:

1. A device for the separation of a powder into a coarse component and a fine component comprising: a housing (1), a material feed (3, 4) into the housing for the material to be fed and a coarse material discharge (8) for the housing and a fines discharge (19) for the housing, the housing (1), the material feed (3, 4) as well as the material discharges (8, 19) forming a cyclone separator, and a sifter (14) being positioned between the material feed (3, 4) and the fines discharge (19) in which the housing includes a flange 11 and which device includes a plate 12 and in which the sifter (14) is mounted on the plate (12) together with the fines discharge (19), which plate 12 is fastened to the flange (11) of the housing in a releasable manner, in which the housing (1) includes a mounting block (21), which bears the plate (12) with attached support (22) in a manner such that it can be pivoted, which device includes a hand wheel (25) and a gear unit (24) for pivoting the support (22) out of the housing (1), which device includes, when the plate (12) supporting the sifter (14) pivots out of the housing (1), a further plate (31) with a plunger tube (32) attached to the flange (11) on housing (1).

2. Device in accordance with claim 1, in which the sifter (14) is a dynamic separator with sizing wheel (15) and drive (16).

3. Device in accordance with claim 2, in which the material feed includes a feed spiral (3) for transporting the feed material and in which the sizing wheel (15) and the feed spiral (3) have the same direction of rotation.

4. Device in accordance with claim 1, in which the housing has a conical section and which includes a secondary sizing chamber (7) connected to the conical section (5) of the housing (1) and which includes nozzles (34) opening into the secondary sizing chamber (7) which nozzles are connected to one or more gas supply lines (35) with valves (36).

5. A device in accordance with claim 1, in which the plate (31) constitutes the top plate of a device converted to a cyclone.

6. A device in accordance with claim 1, in which the coarse material discharge is in the form of a cellular wheel sluice (8).

7. A device in accordance with claim 1, in which the material feed includes a feed tube 4 having a section shape which changes from round to rectangular in the direction of flow of the feed material.

8. A device in accordance with claim 7, in which the feed tube (4) has a sectional area which decreases in the direction of flow of the feed material.

* * * * *